US010113275B2

(12) United States Patent
Berning et al.

(10) Patent No.: US 10,113,275 B2
(45) Date of Patent: Oct. 30, 2018

(54) SELF-PROPELLED GROUND MILLING MACHINE AND METHOD FOR WORKING ON A TRAFFIC SURFACE

(71) Applicant: Wirtgen GmbH, Windhagen (DE)

(72) Inventors: Christian Berning, Zulpich (DE); Philip Verhaelen, Cologne (DE); Cyrus Barimani, Konigswinter (DE)

(73) Assignee: Wirtgen GmbH (DE)

( * ) Notice: Subject to any disclaimer, the term of this patent is extended or adjusted under 35 U.S.C. 154(b) by 7 days.

(21) Appl. No.: 15/331,673

(22) Filed: Oct. 21, 2016

(65) Prior Publication Data

US 2017/0138004 A1 May 18, 2017

(30) Foreign Application Priority Data

Nov. 12, 2015 (DE) ..... 10 2015 014 573

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127; E01C 19/00; E01C 19/004; B28D 7/005; E21C 25/06; E21C 35/24
See application file for complete search history.

(56) References Cited

U.S. PATENT DOCUMENTS

| | | | |
|---|---|---|---|
| 3,266,846 | A | 8/1966 | Luksch et al. |
| 4,221,434 | A | 9/1980 | Swisher, Jr. et al. |
| 4,723,867 | A | 2/1988 | Wirtgen |
| 5,315,770 | A | 5/1994 | Campbell |
| 5,378,081 | A | 1/1995 | Swisher, Jr. |
| 5,607,205 | A | 3/1997 | Burdick et al. |

(Continued)

FOREIGN PATENT DOCUMENTS

| | | | |
|---|---|---|---|
| CN | 102168401 | A | 8/2011 |
| CN | 103215883 | A | 7/2013 |

(Continued)

*Primary Examiner* — Carib A Oquendo
(74) *Attorney, Agent, or Firm* — Lucian Wayne Beavers; Gary L. Montle; Patterson Intellectual Property Law, PC

(57) ABSTRACT

A self-propelled ground milling machine includes a working roller, a hold-down device which is height-adjustable with respect to the traffic surface being arranged upstream of the working roller in the working direction, and a detection unit which determines a physical variable characteristic of an undesirable state of the operating process, wherein fragments are broken off from the traffic surface, apply compressive force to the hold-down device and can press the hold-down device into a raised position with respect to the traffic surface. A device for height-adjusting the hold-down device responds by applying a contact pressure, directed counter to the compressive force applied by the fragments, to the hold-down device. By applying sufficient contact pressure, the hold-down device can be effectively prevented from rising from the traffic surface, such that during the milling process it is at least made more difficult for fragments to break off undesirably from the traffic surface.

30 Claims, 5 Drawing Sheets

(56) References Cited

U.S. PATENT DOCUMENTS

| | | | | |
|---|---|---|---|---|
| 6,296,318 | B1 * | 10/2001 | Simons | E01C 23/088 198/300 |
| 6,457,779 | B1 | 10/2002 | Busley et al. | |
| 6,623,083 | B1 | 9/2003 | Risi | |
| 7,370,916 | B2 | 5/2008 | Lay et al. | |
| 7,387,465 | B2 | 6/2008 | Hall et al. | |
| 7,530,641 | B2 | 5/2009 | Berning et al. | |
| 7,887,142 | B2 | 2/2011 | Hall et al. | |
| 8,047,741 | B2 | 11/2011 | Von Schonebeck et al. | |
| 8,246,270 | B2 | 8/2012 | Berning et al. | |
| 8,764,341 | B2 * | 7/2014 | Menzenbach | E01C 21/00 299/39.2 |
| 8,944,517 | B2 | 2/2015 | Franzmann et al. | |
| 9,016,798 | B2 | 4/2015 | Berning et al. | |
| 9,422,677 | B2 | 8/2016 | Franzmann et al. | |
| 9,551,116 | B2 * | 1/2017 | Heusinger | B05B 15/025 |
| 2002/0047301 | A1 | 4/2002 | Davis | |
| 2005/0123350 | A1 | 6/2005 | Ley et al. | |
| 2007/0286678 | A1 | 12/2007 | Berning et al. | |
| 2008/0153402 | A1 | 6/2008 | Arcona et al. | |
| 2008/0267706 | A1 * | 10/2008 | Hall | E01C 23/088 404/90 |
| 2009/0010713 | A1 * | 1/2009 | Kotting | E01C 19/004 404/128 |
| 2009/0108663 | A1 | 4/2009 | Berning et al. | |
| 2009/0232598 | A1 | 9/2009 | Cochran et al. | |
| 2012/0286558 | A1 | 11/2012 | Berning et al. | |
| 2013/0234495 | A1 | 9/2013 | Miller et al. | |

FOREIGN PATENT DOCUMENTS

| | | | |
|---|---|---|---|
| DE | 29803469 | U1 | 7/1999 |
| DE | 19814053 | A1 | 10/1999 |
| DE | 102006024123 | A1 | 11/2007 |
| DE | 102007044090 | A1 | 4/2009 |
| DE | 102010014529 | A1 | 10/2011 |
| DE | 102012012397 | A1 | 4/2014 |
| DE | 102015002743 | A1 | 6/2016 |
| EP | 1012396 | B1 | 6/2002 |
| EP | 1522634 | A2 | 4/2005 |
| EP | 1936034 | A2 | 6/2008 |
| EP | 2050875 | A2 | 4/2009 |
| EP | 2374937 | A2 | 10/2011 |

* cited by examiner

SELF-PROPELLED GROUND MILLING MACHINE AND METHOD FOR WORKING ON A TRAFFIC SURFACE

BACKGROUND OF THE INVENTION

1. Field of the Invention

The invention relates to a self-propelled ground milling machine, in particular a road milling machine or road recycler, which has a machine frame supported by running gears and a working roller arranged on the machine frame in a roller housing, a hold-down device which is height-adjustable with respect to the traffic surface being arranged upstream of the working roller in the working direction. The invention further relates to a method for working on a traffic surface using a self-propelled ground milling machine, in particular a road milling machine or road recycler, in which the traffic surface is worked on using a working roller arranged in a roller housing, a hold-down device which is height-adjustable with respect to the traffic surface being arranged upstream of the working roller in the working direction.

2. Description of the Prior Art

Known self-propelled ground milling machines have a machine frame, which is supported by an undercarriage which has front and rear running gears, and a working device arranged on the machine frame for working on a traffic surface, for example for removing damaged traffic surfaces or for reconditioning existing traffic surfaces. The working device may comprise a milling and/or cutting roller. Lifting devices are assigned to the individual running gears of the ground milling machine, and can each be retracted and extended in such a way that the machine frame can be lowered and raised with respect to the ground surface. In a rear-loader road milling machine, the milled material is transported away, by a transport device, downstream of the machine in the working direction, where it can subsequently be loaded onto a subsequent transport vehicle, whilst in a front-loader road milling machine, the milled material is transported away via the front face.

In road milling machines, it is known for the working roller to be arranged in a roller housing, which is closed off upstream of the working roller in the working direction by a hold-down device which is height-adjustable with respect to the traffic surface and downstream of the working roller in the working direction by a height-adjustable stripper device. On each side of the roller housing, a height-adjustable edge protector may be located. During the milling process, the height of the hold-down device, stripper device and edge protector is usually set in such a way that the hold-down device and edge protector are positioned on the traffic surface, whilst the stripper device runs in the milled track downstream of the milling roller. During operation of the ground milling machine, the material comminuted by the working roller accumulates in the roller housing. The milled material can remain in the milled track if the stripper device is raised, or be transported out of the roller housing by a transport device and loaded onto a transport vehicle, so as to be able to be supplied to a recycling process for producing new roadmaking material. However, the milled material may also be prepared as early as the milling process.

A front-loader road milling machine comprising a milling roller arranged in a roller housing is known for example from DE 198 14 053 A1. The hold-down device arranged upstream of the milling roller in the working direction is height-adjustable with respect to the ground. For height-adjusting the hold-down device, a piston-cylinder arrangement fixed to the machine frame is provided. If required, however, the hold-down device may merely be raised, and not pressed down.

Self-propelled ground milling machines of the aforementioned construction are also disclosed in U.S. Pat. No. 4,221,434 and US 2013/0234495 A1.

DE 10 2012 012 397 A1 discloses a road milling machine which has a device for height-adjusting the stripper device or edge protector. While the road milling machine is advancing, the stripper device or edge protector is located in a floating position, in such a way that the stripper device or edge protector is positioned on the ground. Preferably, in the floating position, the stripper device or edge protector is positioned with the weight thereof on the ground. However, a predetermined force greater than the weight may also be applied to the stripper device or edge protector by a device for height-adjusting the stripper device or edge protector.

DE 10 2012 012 397 A1 deals with the problem that the stripper device or edge protector can strike against obstacles as the road milling machine advances. The device for raising and lowering the stripper device or edge protector therefore has a measurement unit which detects horizontal forces acting on the stripper device or edge protector. If the horizontal force component is greater than a predetermined threshold, the stripper device or edge protector is raised. This provides for the stripper device or edge protector to avoid obstacles.

The stripper device arranged downstream of the milling roller is generally not configured to follow irregularities in the ground, since the milled track downstream of the milling roller is largely planar. By contrast, the hold-down device arranged upstream of the milling roller is configured to follow irregularities. Therefore, the hold-down device generally has runners formed as expendable parts, in such a way that the hold-down device can slide along over irregularities (US 2013/0234495 A1).

In practice, in the operation of a working roller the problem arises that, in spite of the hold-down device positioned on the traffic surface, larger fragments known as clods may break off from the traffic surface as a result of an inhomogeneous condition or inhomogeneous construction of the traffic surface. Clod formation results in irregularities in the milling process, since the road material is not removed continuously by the milling roller inside the milling roller housing. One possible result of clod formation is that the broken-off material is displaced upstream of the milling roller and thus is not supplied to the milling process, in such a way that the substrate is no longer worked on in a continuous manner. On the other hand, if they arrive in the interior of the milling roller, large fragments may be captured by and accelerated by the milling roller, and thus introduce undesirable forces into the milling roller or the milling roller housing. This can lead to damage to the milling roller or the machine. Furthermore, there is the risk that these large fragments will not be comminuted sufficiently inside the milling roller housing, and therefore milled material will not have the desired particle size distribution at the end of the process. This is disadvantageous in particular if the milled material is intended to be conditioned and used for remaking the road. Furthermore, large fragments can impede the process of transporting the milled material away by the transport device, since they can lead to material build-ups inside the transport channel. If the material jams at the transfer point from the transport device to the transport vehicle, this can disrupt the material discharge. As a result, pieces of the milled material may be deflected in undesired directions, and the material transfer can thus be impeded.

SUMMARY OF THE INVENTION

An object of the invention is to provide a self-propelled ground milling machine by means of which the above-described drawbacks of the prior art are prevented and the operating process during operation of the milling roller is improved. A further object of the invention is to provide a method for working on a traffic surface by means of which the above-described drawbacks are prevented. In particular, an object of the invention is to prevent clod formation during the milling process, in such a way that reproducible milling results can be achieved.

These objects are achieved according to the invention by the features of the independent claims. The dependent claims relate to advantageous embodiments of the invention.

The self-propelled ground milling machine, in particular road milling machine or road recycler, has a machine frame supported by running gears and a working roller arranged on the machine frame in a roller housing, a hold-down device which is height-adjustable with respect to the traffic surface being arranged upstream of the working roller in the working direction. The ground milling machine further comprises a device for height-adjusting the hold-down device and a drive unit for driving the running gears and the working roller.

The device for height-adjusting the hold-down device may be formed in various ways. A device for height-adjusting the hold-down device refers to any device by means of which the hold-down device can be height-adjusted with respect to the traffic surface, it being possible to press the hold-down device onto the traffic surface by a predetermined force or to raise it. The device for height-adjusting the hold-down device may for example comprise one or more piston/cylinder arrangements, so as to be able to apply forces to the hold-down device towards the traffic surface or in the opposite direction. The drive unit for the running gears and the working roller may comprise different drive units or drive trains for driving the running gears and the working roller. The running gears may be caterpillar running gears or wheels.

During the milling process, the hold-down device also has the task of acting as a "counter blade" for the working roller. When the milling roller of a road milling machine rotates counter to the direction of rotation of the running gears of the machine (counter-rotating milling) and the hold-down device is positioned with the inherent weight thereof on the road surface, the hold-down device can generally prevent clods from breaking off from the road surface. In practice, however, it has been found that the force exerted on the road surface by the hold-down device cannot be sufficient for the hold-down device to act as a counter blade for the milling roller. Thus, as a result of the force introduced by the milling roller, part of the road surface can be pressed upwards and the hold-down device can be raised. In principle, there is the option of countering this effect using an increased contact pressure of the hold-down device. However, this measure would result in increased wear on the hold-down device, since in this case the hold-down device would constantly be sliding over the ground surface with an increased contact pressure.

The self-propelled ground milling machine according to the invention is distinguished by a monitoring system for monitoring the operating process, which comprises a detection unit which is formed in such a way that a physical variable characteristic of disruption to the operating process is determined. This disruption is distinguished by fragments being broken off from the traffic surface during work on the traffic surface using the working roller and applying a compressive force to the height-adjustable hold-down device. The compressive force applied to the movable hold-down device by the fragments has the result that the hold-down device is pressed into a raised position with respect to the traffic surface. This is how disruption to the operating process can initially be detected.

Furthermore, the device for height-adjusting the hold-down device is formed in such a way that a contact pressure, directed counter to the compressive force applied by the fragments, is applied to the hold-down device when the detection unit detects the disruption to the operating process. As a result of the application of this compressive force, the resulting fragments are initially held in position by the hold-down device, and thus prevented from being displaced upstream of the milling roller. This further ensures that the fragments are successively comminuted, and not captured as a whole by the milling roller and accelerated in the milling roller housing. Overall, the applied compressive force thus results in it being possible to continue the milling process substantially without impediment in spite of large fragments or clods breaking off.

Furthermore, by applying a sufficient contact pressure, the hold-down device can be effectively prevented from lifting off from the traffic surface. When the hold-down device is positioned on the traffic surface, it is at least made more difficult for further fragments to break off from the traffic surface. The increased contact pressure of the hold-down device ensures that any clods are supplied to the milling process in a controlled manner and further clods are effectively prevented from breaking off, in such a way that there is no risk of damage to the working roller or other components of the ground milling machine or objects in the vicinity of the machine. Furthermore, the vehicle driver is not subjected to jolts or impacts which result from the clods breaking off, and so the comfort for the vehicle driver is also increased.

As long as no disruption to the operating process is detected, the contact pressure of the hold-down device should preferably be of a size such that the gap between the lower edge of the hold-down device and the surface of the traffic surface is as small as possible or the hold-down device is positioned on the traffic surface, so as to prevent the milled material from escaping from the milling roller housing. On the other hand, for reasons of unnecessary energy consumption by the drive unit or wear on the hold-down device, the contact pressure should not be too high.

A major advantage of the setting according to the invention of the contact pressure of the hold-down device is that the increase in the contact pressure takes place only as required, fully automatically, and without the machine driver having to intervene in the machine control system. The machine driver can thus concentrate on actually controlling the machine. The wear on the relevant components of the ground milling machine is much lower than if the contact pressure of the hold-down device is permanently increased throughout the milling process.

It is known from the prior art that the hold-down device is formed in such a way that it is constantly positioned on the traffic surface with a predetermined force, in particular with the weight thereof, in a floating position. The hold-down device is therefore subject to some amount of wear.

The setting according to the invention of the contact pressure of the hold-down device makes it possible to operate the hold-down device in the floating position with a reduced contact pressure on the traffic surface if clod formation does not occur. In this case, the hold-down device in the floating position can be raised slightly counter to the weight thereof, in such a way that it slides over the traffic surface with a force less than the weight thereof. This contact pressure is only increased when clod formation occurs. As a result, the wear on the hold-down device can be reduced.

A further preferred embodiment of the invention provides that the device for height-adjusting the hold-down device is formed in such a way that a contact pressure directed counter to the compressive force is applied to the hold-down device for a predetermined time interval. Once the predetermined time interval passes, it can be checked whether disruptions to the milling process occur again when the contact pressure is reduced. If disruptions to the milling process occur again, the contact pressure is increased again. The hold-down device is thus only operated with an increased contact pressure when clod formation is established.

A particularly preferred embodiment provides that the device for height-adjusting the hold-down device is formed in such a way that the contact pressure directed counter to the compressive force is increased as long as the detection unit detects disruptions to the operating process. In this case, the contact pressure can be increased incrementally or continuously. For example, the hold-down device may initially only be positioned on the traffic surface with its inherent weight in a floating position. In the event of clod formation, the device for height-adjustment then exerts an additional contact pressure on the hold-down device. However, it is also possible for the hold-down device initially to be positioned on the traffic surface with a weight less than the inherent weight thereof; in other words the load on the hold-down device is relieved, in a first step on the hold-down device, and subsequently a predetermined contact pressure is applied, and is optionally increased until clod formation no longer occurs.

For detecting the disruption to the operating process, the occurrence of a characteristic physical variable, which cannot be found in a correct state, or the change in a characteristic physical variable, which also cannot be found in a correct state, may be evaluated.

The detection unit may comprise an evaluation unit which is formed in such a way that at least one value of the physical variable characteristic of the disruption to the operating process is compared with at least one value of the physical variable which occurs in a correct state. In this case, the comparison variable may be a predetermined threshold. If a plurality of values are evaluated, known statistical evaluation methods may be used, for example averaging may be carried out. Upper and lower thresholds may also be defined. It is also possible to detect the disruption to the operating process, in other words the clod formation, by evaluating various characteristic physical variables. If the evaluation is based on a plurality of physical variables, the redundancy for detecting the disruption can be increased.

A particularly preferred embodiment provides that the detection unit comprises a measurement unit which is formed in such a way that a movement of the hold-down unit, due to a compressive force which acts on the hold-down device when fragments are broken off from the traffic surface during work on the traffic surface using the working roller, is detected. In this way, the reaction of the movable hold-down device to the clod formation is detected. The movement of the hold-down device may for example be detected directly at the hold-down device or parts connected to the hold-down device or else indirectly in the hydraulic system of the device for height-adjusting the hold-down device.

In an embodiment which is found to be particularly simple in terms of technical implementation, the measurement unit has, for detecting the movement of the hold-down device, a distance sensor which measures the distance through which the hold-down device is lifted with respect to the traffic surface as a result of fragments breaking off from the traffic surface. Preferably, the evaluation unit of the detection unit is formed in such a way that the magnitude of the distance through which the hold-down device is lifted is compared with a predetermined threshold, it being concluded that there is disruption to the operating process if the magnitude of the distance is greater than the threshold. The distance may be measured at the hold-down device itself or at components connected to the hold-down device. For example, if the hold-down device is connected to a piston/cylinder arrangements, movement of the piston or cylinder of the piston/cylinder arrangement or a relative movement between the piston and the cylinder may also be detected.

A particularly preferred embodiment provides that the change in the distance over time, in other words the acceleration of the hold-down device, is detected. The change in the distance over time is compared with a threshold. If the threshold is exceeded, it is concluded that there is disruption to the operating process. Slow changes in the height of the hold-down device may also have other causes; however, clod formation leads to abrupt changes in height.

In an alternative embodiment, instead of the movement of the hold-down device or components connected thereto, a compressive force acting on the hold-down device due to fragments breaking off from the traffic surface is detected, this force being directed counter to the force with which the hold-down device is positioned on the traffic surface, for example counter to the weight of the hold-down device in the floating position. In this embodiment, the detection unit has a measurement unit, which has a force sensor which measures a compressive force acting on the hold-down device. The force sensor may be provided on the hold-down device itself or on components connected to the hold-down device. Instead of a force measurement by a force sensor, for example the pressure in the hydraulic system of the device for height-adjusting the hold-down device may also be measured.

Preferably, the evaluation unit of the detection unit is formed in such a way that the magnitude of the compressive force acting on the hold-down device is compared with a predetermined threshold, it being concluded that there is disruption to the operating process if the magnitude of the compressive force is greater than the threshold.

It has been found that the fragments which break off from the traffic surface exert a force on the hold-down device which has a substantially vertical component, in other words perpendicular to the surface of the traffic surface. Therefore, the force sensor may be formed in such a way that a force component acting vertically on the hold-down device is measured.

The disruption may also be detected by detecting only slight movements of the hold-down device, in other words impacts and/or oscillations to which the hold-down device is subjected when the fragments break off from the traffic surface. These impacts and/or oscillations, which are transmitted to the hold-down device directly from the clods, may in particular be detected at the hold-down device itself.

However, the impacts and/or oscillations may also be detected at other components of the machine, since the impacts and/or oscillations are transmitted to the machine frame on which the hold-down device is arranged, for example by means of a height-adjustable guide of the hold-down device on the machine frame. The detection unit preferably has a measurement unit, which has an impact sensor and/or oscillation sensor which is arranged in particular on the hold-down device. Preferably, the evaluation unit of the detection unit is formed in such a way that the amplitude of the impacts and/or oscillations is compared with a predetermined threshold, it being concluded that there is disruption to the operating process if the magnitude of the amplitude is greater than the threshold. However, the detection unit may also have a filter which prevents the detection of impacts or vibrations introduced into the system by the drive unit or by the rotation of the milling roller, for example.

Instead of the amplitude of the impacts and/or oscillations, the frequency of the impacts and/or oscillations may also be evaluated; for example, particular frequencies or frequency ranges may be detected which are characteristic of disruption to the operating process. In practice, an oscillation sensor for detecting the frequency of impacts and/or vibrations will constantly detect relatively high-frequency oscillations generated for example by the engine and/or the milling roller. Clods breaking off can be detected by detecting impacts and/or oscillations of a frequency lower than the frequency of the relatively high-frequency oscillations which are detected during correct operation. Impacts and/or oscillations of relatively low frequencies occur for example if clods which have broken off still strike the hold-down device.

It has been found that when the clods are removed a load is placed on the drive unit and/or the drive train, and so monitoring the drive unit and/or the drive train makes it possible to detect the disruption to the operating process. If the drive unit does not counter the additional load due to the clod formation by increasing the engine power, this results in a power drop, which can be detected. However, even if the engine power is controlled, power fluctuations of the drive unit and torque fluctuations in the drive train occur, and can be monitored.

In a further embodiment, the detection unit has a measurement unit, which is formed in such a way that power fluctuations of the drive unit and/or torque fluctuations in the drive train due to fragments breaking off from the traffic surface are detected. The evaluation unit of the detection unit is preferably formed in such a way that in the event of a power fluctuation or torque fluctuation by a predetermined magnitude it is concluded that there is disruption to the milling process.

BRIEF DESCRIPTION OF THE DRAWINGS

In the following, an embodiment of the invention is described in greater detail with reference to the drawings, in which.

DETAILED DESCRIPTION

Figure 1:
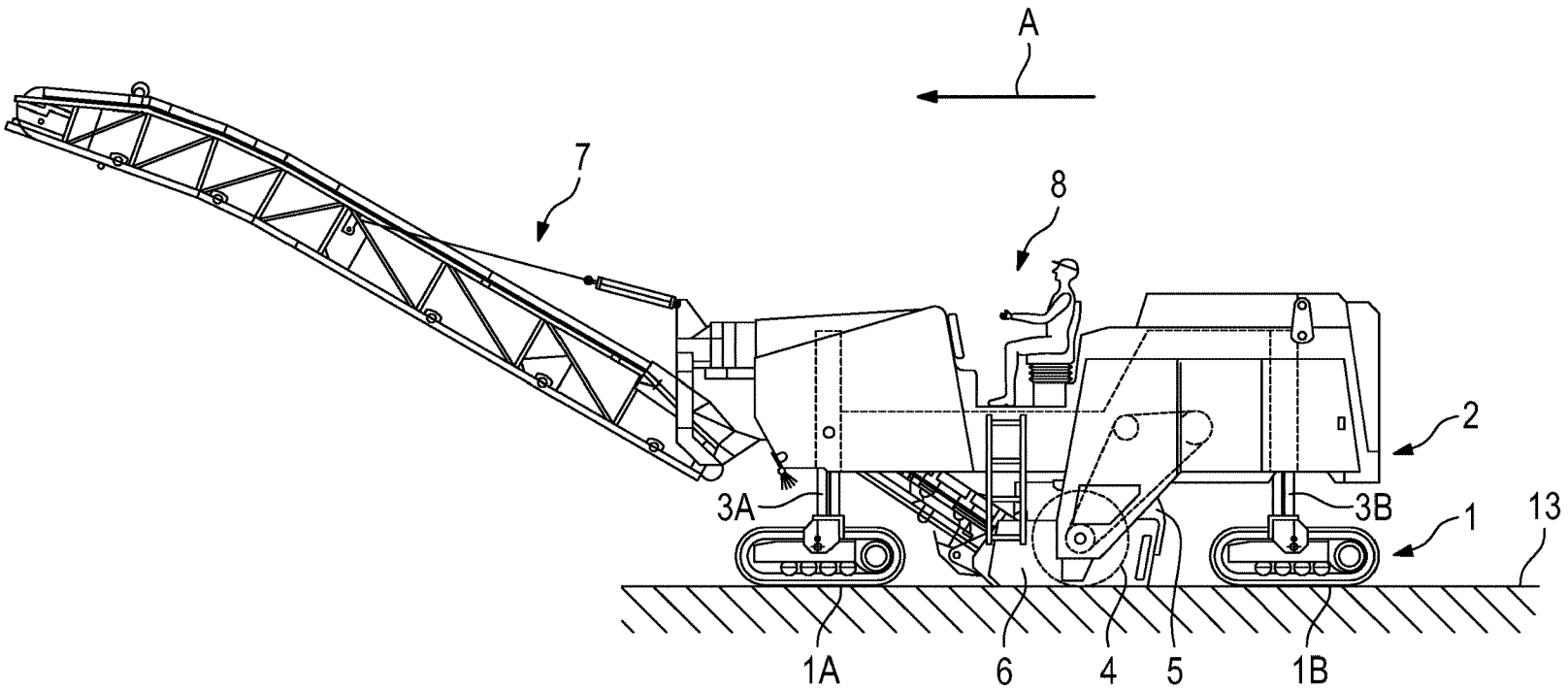
FIG. 1 is a side view of a road milling machine as an example of a self-propelled ground milling machine.

FIG. 1 shows a road milling machine for milling off asphalt, concrete or similar road surfaces as an example of a self-propelled ground milling machine. The road milling machine comprises a machine frame 2 supported by an undercarriage 1. The undercarriage 1 comprises front and rear running gears 1A, 1B, which are arranged on the right and left side of the machine frame 2 in the working direction A. The running gears 1A, 1B are fixed to lifting columns 3A, 3B which are attached to the machine frame 2, in such a way that the machine frame 2 is height-adjustable with respect to the traffic surface 13.

The road milling machine has a working roller 4, which is equipped with milling tools (not shown). The milling roller 4 is arranged on the machine frame 2 between the front and rear running gears 1A, 1B in a milling roller housing 5. The axis of rotation of the milling roller extends transversely to the working direction A of the milling machine. The milling roller housing 5 is closed off (FIG. 3A) at the front face in the working direction A by a hold-down device 11 (not shown in FIG. 1) and at the rear face by a stripper device 12 (not shown in FIG. 1). At the longitudinal faces, the roller housing is closed off by an edge protector 6. The milled material which is milled off can be transported away by a transport device 7. The driver's platform 8 is located on the machine frame 2, above the milling roller housing 5.

Figure 2:
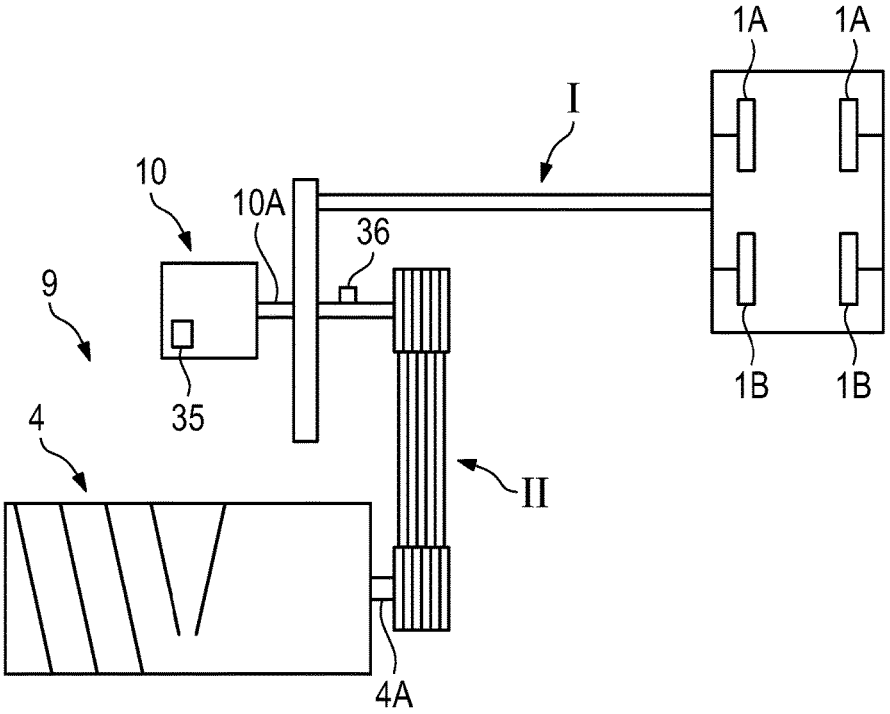
FIG. 2 is a schematic view of the drive unit for driving the running gears or wheels of the self-propelled ground milling machine.

The road milling machine has a drive unit 9 which has an internal combustion engine 10. As well as the milling roller 4, the internal combustion engine 10 also drives the running gears 1A, 1B and further units of the milling machine. A first drive train I is used for transmitting the drive power from the internal combustion engine 10 to the running gears 1A, 1B, whilst a second drive train II is used for transmitting the drive power to the milling roller 4. In the present embodiment, the first drive train I is a hydraulic drive train and the second drive train II is a mechanical drive train. The drive trains I and II may each comprise one or more transmissions (FIG. 2).

Figure 3A:
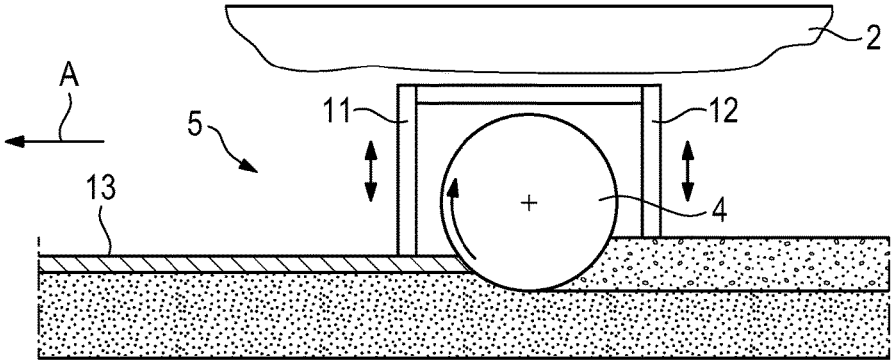
FIG. 3A is a schematic view of the roller housing of the ground milling machine.

FIG. 3A is a highly simplified schematic view of the milling roller housing 5 and of the milling roller 4. The milling roller housing 5 is closed off by the hold-down device 11 at the front face in the working direction A. The hold-down device 11 may also have runners. Hold-down devices of this type, which may consist of one or more parts, are found in the prior art. On the rear face in the working direction A, the milling roller housing 5 is closed off by the stripper device 12. The hold-down device 11 is positioned on the traffic surface 13 by the lower end thereof and is height-adjustable. The stripper device 12 is also height-adjustable. In the present embodiment, the milled material remains in the milled track. However, during the milling process, the material which is milled off may also be transported out of the milling roller housing 5 by a transport device 7 (not shown in FIG. 3).

Figure 4:
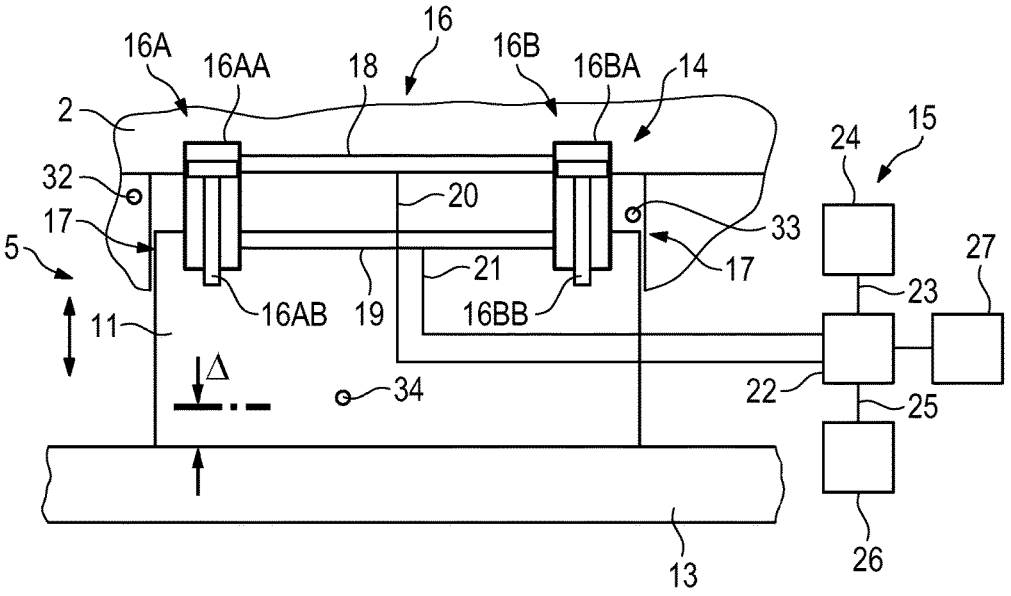
FIG. 4 is a schematic view of the hold-down device and the device for height-adjusting the hold-down device.

FIG. 4 is a highly simplified view of the hold-down device and of a device 14 for height-adjusting the hold-down device 11 in the direction counter to the working direction A of the road milling machine. The hold-down device 11 extends transversely to the working direction of the road milling machine.

The device for height-adjusting the hold-down device comprises a hydraulic unit 15 and a piston/cylinder unit 16, which in the present embodiment comprises two piston/cylinder arrangements 16A, 16B, arranged at a distance from one another on the two sides of the hold-down device 11. The height-adjustable hold-down device 11 is guided in lateral guides 17 on the machine frame 2. In the present embodiment, the cylinders 16AA, 16BA of the piston/cylinder arrangements 16 are fixed to the machine frame 2 and the pistons 16AB, 16BB of the piston/cylinder arrangements 16 are fixed to the hold-down device 11, in such a way that the hold-down device 11 can be raised or lowered by actuating the piston/cylinder arrangements 16. The piston/cylinder arrangements 16 are actuated by means of the hydraulic unit 15.

The upper cylinder spaces of the two piston-cylinder arrangements 16 are short-circuited via a first hydraulic line 18, and the lower cylinder spaces of the piston-cylinder arrangements 16 are short-circuited via a second hydraulic line 19. A third hydraulic line 20 leads from the first hydraulic line 18 and a fourth hydraulic line 21 leads from the second hydraulic line 19 to a hydraulic valve arrangement 22, which is actuated by a central control unit 27, which may be part of the central control unit of the road milling machine.

During the milling process, the hold-down device 11 may be located in a floating position, in such a way that the hold-down device 12 is positioned with the weight thereof on the surface of the traffic surface 13. In the floating position, the hydraulic valve arrangement 22 connects the third and fourth hydraulic lines 20, 21 via a tank line 23 to a hydraulic tank 24, in such a way that the upper and lower cylinder spaces of the hydraulic cylinder 16AA, 16BA are not subjected to pressure. Since no specific hydraulic force acts on the pistons, the pistons can be displaced in the cylinders, in such a way that the hold-down device 11 is moved downwards under the weight thereof and can slide over the traffic surface 13.

However, the device 14 for height-adjustment also makes it possible to apply a defined contact pressure to the hold-down device 11, which is greater than the weight in the floating position. For this purpose, the hydraulic valve arrangement 22 connects the third hydraulic line 20 via a pressure line 25 to a pressure medium source 26, and the fourth hydraulic line 21 via the tank line 23 to the hydraulic tank 24, in such a way that the hold-down device 11 is pressed downwards onto the traffic surface 13 by a defined contact pressure, the contact pressure being predetermined by the pressure medium source 26. To raise the hold-down device, the hydraulic valve arrangement 22 connects the third hydraulic line 20 to the hydraulic tank 24 and the fourth hydraulic line 21 to the pressure medium source 26.

Figure 3B:
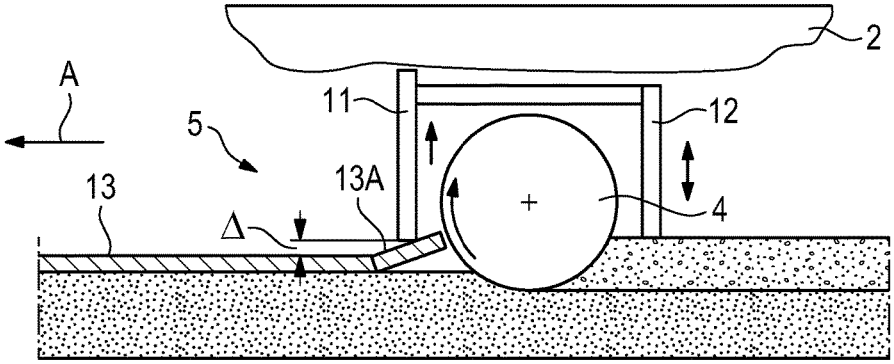
FIG. 3B is a schematic view of the roller housing of the ground milling machine, in which a fragment is breaking off from the traffic surface.
Figure 5A:
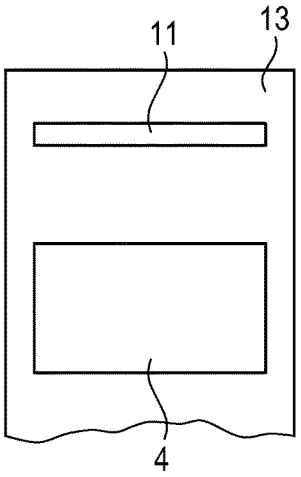
FIG. 5A is a plan view of the working roller and the hold-down device when no fragments are being broken off from the traffic surface.
Figure 5B:
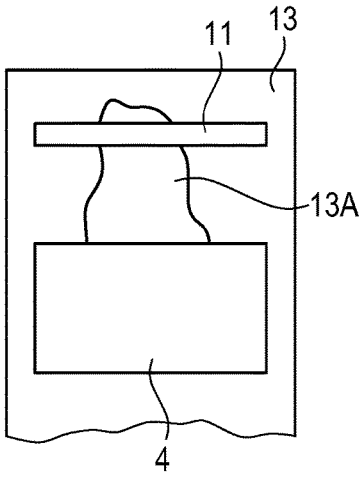
FIG. 5B is a plan view of the working roller and the hold-down device when fragments are being broken off from the traffic surface.
Figure 6A:
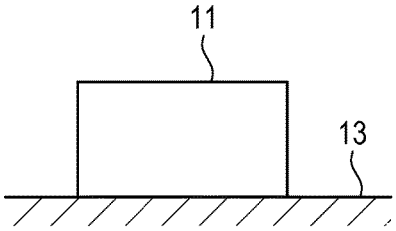
FIG. 6A is a front view of the hold-down device when no fragments are being broken off from the traffic surface.
Figure 6B:
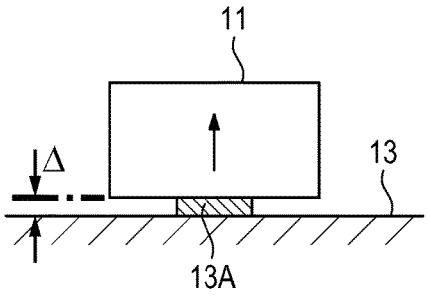
FIG. 6B is a front view of the hold-down device when fragments are being broken off from the traffic surface.

FIGS. 5A and 5B and FIGS. 6A and 6B are schematic plan views and front views, respectively, of the working roller 4 and of the hold-down device 11, in which no large fragments (clods) are breaking off from the traffic surface in FIGS. 5A and 6A, whilst large fragments 13A (clods) are breaking off from the traffic surface in FIGS. 5B and 6B. FIG. 3B is a side view of the milling roller housing 5 together with the working roller 4 and the hold-down device 11 when a clod 13A is breaking off from the traffic surface 13.

In the drawings, it can be seen that in a correctly running operating process no compressive forces having a vertical component act on the height-adjustable hold-down device 11 when the milled material is comminuted using the milling roller 4, since the hold-down device is arranged at a sufficient distance from the milling roller. By contrast, when clods break off, the fragments are sufficiently large that they can extend out of the milling roller housing below the lower edge of the hold-down device 11 or above the upper edge of the hold-down device. These clods apply a contact pressure having a vertical component to the hold-down device, which leads to an upward movement of the hold-down device 11.

The self-propelled ground milling machine further has a monitoring system 28 for monitoring the operating process, so as to detect fragments breaking off from the traffic surface 13. If fragments break off from the traffic surface during the milling process, the clods apply a compressive force to the hold-down device 11, which is greater than the weight with which the hold-down device 11 is positioned on the traffic surface in the floating position. As a result, the hold-down device 11 is displaced upwards by the clods. This undesirable state is detected by the monitoring system 28.

Figure 7:
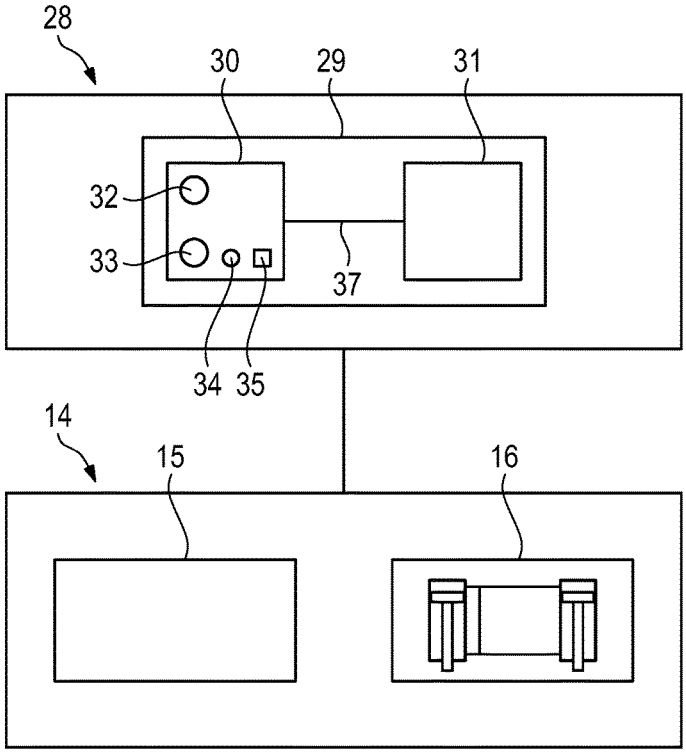
FIG. 7 is a schematic diagram of the individual components of the monitoring system for monitoring the milling process and of the device for height-adjusting the hold-down device.

FIG. 7 is a schematic diagram of the monitoring system 28 and of the device 14 for height-adjusting the hold-down device. The monitoring system 28 comprises a detection unit 29 which detects a physical variable which is characteristic of the disruption to the milling process. The detection unit 29 comprises a measurement unit 30 and an evaluation unit 31. The measurement unit 30 comprises a sensor or a plurality of sensors 32, 33, 34, 35, 36 (FIG. 2) for detecting the physical variable characteristic of the disruption to the operating process.

In a first embodiment, the sensor of the measurement unit 30 is a distance sensor 32, which measures the distance through which the hold-down device is raised from the position adopted by the hold-down device in the floating position. FIG. 4 shows, by means of a dashed line, the lower edge of the hold-down device 11, which has been raised through the distance Δ from the floating position by a clod (FIG. 6B). The distance sensor 32 may for example be arranged in the region of the lateral guides 17 between the machine frame 2 and the hold-down device 11. The measurement unit 30 is connected via a data line 37 to the evaluation unit 31, in such a way that the evaluation unit 31 can evaluate the measurement values from the measurement unit 30. The evaluation unit 31 is configured in such a way that the measured distance is compared with a threshold. If the distance is greater than the threshold, the evaluation unit 31 generates a control signal for the control unit 27, by means of which the hydraulic valve arrangement 22 is actuated in such a way that the hydraulic valve arrangement connects the third hydraulic line 20 to the pressure medium source 26 and the fourth hydraulic line 21 to the hydraulic tank 24, in such a way that the hold-down device 11 is pressed onto the traffic surface 13 by a contact pressure predetermined by the pressure medium source 16. The hold-down device 11 is thus again located in the previously adopted position in which it is firmly positioned on the traffic surface 13, in such a way that the large fragments 13A are not displaced upstream of the milling roller housing in the working direction or captured by the milling roller and pulled into the milling roller housing in an uncontrolled manner. Furthermore, fragments are prevented from continuing to break off.

After a predetermined time interval passes, the evaluation unit 31 can generate a control signal for the control unit 27, by means of which the hydraulic valve arrangement 22 is actuated in such a way that the third and fourth hydraulic lines 20, 21 are connected to the hydraulic tank 24, in such a way that the upper and lower cylinder spaces of the hydraulic cylinders 16AA, 16BA are not subjected to the system pressure, and the hold-down device 11 is again located in the floating position, in which it is no longer pressed onto the ground by the increased contact pressure. If clod formation is no longer occurring after the predetermined time interval passes, there is no longer force acting on the hold-down device which might press it upwards. By contrast, if clod formation is still occurring, the resulting upward movement of the hold-down device 11 is detected by the monitoring system 28, whereupon the contact pressure is increased again.

In an alternative embodiment, the evaluation unit 31 is configured in such a way that the change in the measured distance over time, in other words the acceleration of the hold-down device 11, is calculated. The evaluation unit 31 compares the change in the distance over time with a threshold. If the distance is greater than the threshold, the evaluation unit 31 generates the control signal for the control unit 27, in such a way that the hold-down device 11 is pressed onto the traffic surface 13 by a predetermined contact pressure.

The contact pressure of the hold-down device 11 is predetermined by the operating pressure to which the piston-cylinder arrangements 16A, 16B are subjected by the pressure medium source 26. Upon exceeding the threshold, the pressure may be increased to a predetermined maximum pressure immediately or be increased to the maximum pressure incrementally or continuously until disruptions to the milling process are no longer being detected by the detection unit.

In a second embodiment, the sensor of the measurement unit is a force sensor 33, which measures a compressive force which acts on the hold-down device and which presses the hold-down device upwards when fragments are breaking off from the traffic surface. The force sensor 33 is preferably formed or arranged in such a way that only a substantially vertical force component which can be applied to the hold-down device by fragments is measured. The force sensor 33 may for example be arranged in the region of the lateral guides 17 between the machine frame 2 and the hold-down device 11 (FIG. 4). The evaluation unit 31 evaluates the measured compressive force analogously to the distance. If the compressive force or the change in the compressive force over time is greater than a predetermined threshold, the evaluation unit 31 concludes that there is disruption to the milling process, and generates the control signal, in such a way that the hold-down device 11 is pressed onto the traffic surface 13 by the predetermined contact pressure.

In a third embodiment, the measurement unit 30 comprises an impact sensor 34 and/or oscillation sensor, which measures impacts and/or oscillations of the hold-down device 11 due to fragments breaking off from the traffic surface 13. The impact sensor and/or oscillation sensor 34 is preferably arranged on the hold-down device 11, since the hold-down device 11 is directly exposed to impacts when clods break off, or oscillations are transmitted directly to the hold-down device. The evaluation unit 31 compares the amplitude of the impacts and/or oscillations with a predetermined threshold, the contact pressure of the hold-down device 11 being increased analogously if the threshold is exceeded for a predetermine time interval. Once the time interval passes, it is analogously rechecked whether the disruption to the milling process is occurring again. However, impacts or oscillations may also alternatively be detected in the hydraulic system of the device 14 for height-adjusting the hold-down device 11. For this purpose, one or more pressure sensors for measuring fluctuations in the hydraulic pressure may be provided in the hydraulic system. Instead of the amplitude of the impacts and/or oscillations, the frequencies of the impacts and/or oscillations may also be evaluated. One embodiment provides that the evaluation unit 31 is formed in such a way that it is concluded that there is disruption to the operating process if the impacts and/or oscillations fall within a characteristic frequency range. The frequency range characteristic of disruption to the operating process may for example be determined in tests.

In a further alternative embodiment, the monitoring system monitors the drive unit 9 of the road milling machine. A clod breaking off results in a brief power drop. In the present embodiment, to detect the disruption to the milling process, power fluctuations in the internal combustion engine 4 are monitored, which result in a brief fluctuation in the engine rotational speed. In this embodiment, the measurement unit 30 comprises a rotational speed sensor 35 which measures the rotational speed of the internal combustion engine 10. If the rotational speed fluctuations exceed a threshold, the contact pressure of the hold-down device 11 is increased.

If fragments are breaking off from the traffic surface 13, it is predominantly the mechanical drive train II, via which the drive power of the internal combustion engine 10 is transferred to the milling roller 4, that is subjected to the load (FIG. 2). Therefore, to detect disruption to the operating process, loads on components of the drive train, for example the load on drive shafts etc., may be monitored. In a further embodiment, torque fluctuations in the mechanical drive train II are detected. If the torque fluctuations are greater than a predetermined threshold, it is concluded that there is disruption to the milling process. For example, expansion sensors 36, which detect a torsional load on the shafts so as to detect the undesirable state, may be arranged on the driven shaft 10A of the internal combustion engine 10 or the drive shaft 4A of the milling roller 4.

What is claimed is:

1. A method for working a traffic surface using a self-propelled ground milling machine, wherein the machine comprises a working roller arranged in a roller housing, a hold-down device which is height-adjustable with respect to the traffic surface being arranged upstream of the working roller in a working direction, and one or more sensors, the method comprising:

detecting, via the one or more sensors, a physical variable characteristic of disruption to an operating process, wherein a compressive force is applied counter to a force exerted by a weight of the hold-down device by fragments broken off from the traffic surface; and upon detecting the disruption to the operating process, automatically applying a contact pressure to the hold-down device, said contact pressure directed counter to the compressive force applied by the fragments.

2. The method of claim 1, wherein the contact pressure applied to the hold-down device is increased until the disruption to the operating process is no longer detected.

3. The method of claim 1, wherein the contact pressure applied to the hold-down device is applied for a predetermined time interval.

4. The method of claim 1, wherein the step of detecting a physical variable characteristic of disruption to an operating process comprises:

detecting a movement of the hold-down device due to a compressive force which acts on the hold-down device when fragments are broken off from the traffic surface during work on the traffic surface using the working roller.

5. The method of claim 1, further comprising:

measuring a distance the hold-down device is raised with respect to the traffic surface as a result of fragments breaking off from the traffic surface; and comparing one or more of a magnitude of the distance and a change over time in the magnitude of the distance with a predetermined threshold, wherein a disruption to the operating process is detected if the magnitude of the distance or the change in the magnitude of the distance over time is greater than the threshold.

6. The method of claim 1, further comprising:

detecting one or more of impacts and oscillations which occur as a result of fragments breaking off from the traffic surface; and comparing an amplitude of the impacts and/or oscillations with a predetermined threshold, wherein a disruption to the operating process is detected if a magnitude of the amplitude is greater than the threshold.

7. The method of claim 1, further comprising:

detecting a compressive force which acts on the hold-down device if fragments are broken off from the traffic surface during work on the traffic surface using the working roller; and comparing a magnitude of the compressive force acting on the hold-down device with a predetermined threshold, wherein a disruption to the operating process is detected if the magnitude of the compressive force is greater than the threshold.

8. The method of claim 1, wherein the step of detecting a physical variable characteristic of disruption to an operating process comprises:

detecting one or more of power fluctuations of a drive unit and torque fluctuations in a drive train due to fragments breaking off from the traffic surface, wherein a disruption to the operating process is detected in the event of power fluctuations and/or torque fluctuations of a predetermined magnitude.

9. A self-propelled ground milling machine, comprising:

a machine frame supported by running gears;

a working roller arranged on the machine frame in a roller housing;

a hold-down device which is height-adjustable with respect to a traffic surface and arranged upstream of the working roller in a working direction;

one or more sensors configured to detect a physical variable characteristic of disruption to an operating process, during which disruption fragments are broken off from the traffic surface during work on the traffic surface using the working roller and apply a compressive force to the hold-down device, counter to a force exerted by a weight thereof; and a control unit configured, responsive to a detected disruption to the operating process, to actuate height adjustment of the hold-down device, wherein a contact pressure is directed counter to the compressive force applied by the fragments.

10. The self-propelled ground milling machine of claim 9, wherein one of the one or more sensors comprises a distance sensor which measures a distance through which the hold-down device is raised with respect to the traffic surface as a result of fragments breaking off from the traffic surface.

11. The self-propelled ground milling machine of claim 10, wherein a disruption to the operating process is detected if a magnitude of the distance or a change in the magnitude of the distance over time is greater than a predetermined threshold.

12. The self-propelled ground milling machine of claim 9, wherein one or more of the sensors comprises an impact sensor and/or an oscillation sensor.

13. The self-propelled ground milling machine of claim 12, wherein a disruption to the operating process is detected if a magnitude of the amplitude of sensed impacts and/or oscillations is greater than a predetermined threshold.

14. The self-propelled ground milling machine of claim 12, wherein a disruption to the operating process is detected if the sensed impacts and/or oscillations fall within a characteristic frequency range.

15. The self-propelled ground milling machine of claim 9, wherein one of the one or more sensors comprises a force sensor configured to detect a compressive force which acts on the hold-down device if fragments are breaking off from the traffic surface during work on the traffic surface using the working roller.

16. The self-propelled ground milling machine of claim 15, wherein a disruption to the operating process is detected if a magnitude of the compressive force acting on the hold-down device is greater than a predetermined threshold.

17. The self-propelled ground milling machine of claim 9, wherein one or more of the sensors is configured to detect one or more of power fluctuations of a drive unit and torque fluctuations in a drive train due to fragments breaking off from the traffic surface.

18. A self-propelled ground milling machine, comprising:

a machine frame supported by running gears;

a working roller arranged on the machine frame in a roller housing;

a hold-down device which is height-adjustable with respect to a traffic surface and arranged upstream of the working roller in a working direction;

one or more sensors configured to detect a physical variable characteristic of disruption to an operating process, during which disruption fragments are broken off from the traffic surface during work on the traffic surface using the working roller and apply a compressive force to the hold-down device, counter to a force exerted by an inherent weight thereof; and a device for height-adjusting the hold-down device, configured to apply a contact pressure to the hold-down device, directed counter to the compressive force applied by the fragments, when the disruption to the operating process is detected.

19. The self-propelled ground milling machine of claim 18, wherein the device for height-adjusting the hold-down device comprises one or more piston/cylinder arrangements and a hydraulic system actuated by a control unit, wherein the control unit is connected to receive control signals representative of a detected disruption to the operating process.

20. The self-propelled ground milling machine of claim 18, further comprising a control unit configured to actuate the device for height-adjusting the hold-down device to increase the contact pressure counter to the compressive force for as long as the disruption to the operating process is detected.

21. The self-propelled ground milling machine of claim 18, further comprising a control unit configured to actuate the device for height-adjusting the hold-down device to apply the contact pressure counter to the compressive force for a predetermined time interval.

22. The self-propelled ground milling machine of claim 18, wherein one or more of the sensors is configured to detect a movement of the hold-down device due to fragments breaking off from the traffic surface.

23. The self-propelled ground milling machine of claim 22, wherein one or more of the sensors comprises a distance sensor which measures a distance through which the hold-down device is raised with respect to the traffic surface as a result of fragments breaking off from the traffic surface.

24. The self-propelled ground milling machine of claim 23, wherein a disruption to the operating process is detected if a magnitude of the distance or a change in the magnitude of the distance over time is greater than a predetermined threshold.

25. The self-propelled ground milling machine of claim 18, wherein one or more of the sensors comprises an impact sensor and/or an oscillation sensor.

26. The self-propelled ground milling machine of claim 25, wherein a disruption to the operating process is detected if a magnitude of the amplitude of sensed impacts and/or oscillations is greater than a predetermined threshold.

27. The self-propelled ground milling machine of claim 25, wherein a disruption to the operating process is detected if the sensed impacts and/or oscillations fall within a characteristic frequency range.

28. The self-propelled ground milling machine of claim 18, wherein one of the one or more sensors comprises a force sensor configured to detect a compressive force which acts on the hold-down device if fragments are breaking off from the traffic surface during work on the traffic surface using the working roller.

29. The self-propelled ground milling machine of claim 28, wherein a disruption to the operating process is detected if a magnitude of the compressive force acting on the hold-down device is greater than a predetermined threshold.

30. The self-propelled ground milling machine of claim 18, wherein one or more of the sensors is configured to detect one or more of power fluctuations of a drive unit and torque fluctuations in a drive train due to fragments breaking off from the traffic surface.

* * * * *